United States Patent [19]

de Groot et al.

[11] Patent Number: 4,635,018

[45] Date of Patent: Jan. 6, 1987

[54] CORE CONTAINING AMORPHOUS FERROMAGNETIC STRIP MATERIAL

[75] Inventors: Jacob de Groot, Tilburg; Thomas A. J. Haus, Veldhoven, both of Netherlands

[73] Assignee: U.S. Philips Corporation, New York, N.Y.

[21] Appl. No.: 825,838

[22] Filed: Feb. 4, 1986

[30] Foreign Application Priority Data

Feb. 7, 1985 [NL] Netherlands ..... 8500338

[51] Int. Cl.[4] ..... H01F 27/24

[52] U.S. Cl. ..... 336/178; 336/212; 336/217; 336/234

[58] Field of Search ..... 336/210, 212, 213, 178, 336/233, 234, 216, 217; 29/605, 609

[56] References Cited

U.S. PATENT DOCUMENTS

| | | | |
|---|---|---|---|
| 3,104,364 | 9/1963 | Richardson, Jr. | 336/213 |
| 3,638,302 | 2/1972 | Wilk | 336/210 X |
| 3,792,399 | 2/1974 | McLyman | 336/210 |

*Primary Examiner*—Thomas J. Kozma

*Attorney, Agent, or Firm*—Robert T. Mayer; Bernard Franzblau

[57] ABSTRACT

A core for an inductor or transformer includes a number of concentric turns of a ferromagnetic strip material. An inner core portion (13) consists of a non-amorphous material and an outer core portion (27) consists of an amorphous material. The transition between the two core portions (13, 27) is formed by a welded joint between the overlapping outer (17) and inner (15) end portions of the outer turn of the inner core portion (13), and with the inner end portion (19) of the inner turn (33) of the outer core portion (27) disposed therebetween.

12 Claims, 5 Drawing Figures

CORE CONTAINING AMORPHOUS FERROMAGNETIC STRIP MATERIAL

Figure 1:
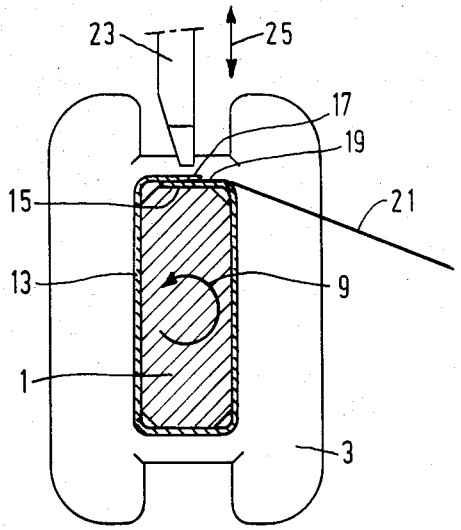

The invention relates a core for an electric coil or transformer which includes a number of concentric turns of a ferromagnetic strip material and in which an inner core portion which includes at least one turn consists of a non-amorphous material while an outer core portion which encloses the inner core portion consists of an amorphous material.

A core of this kind is known from GB-A No. 2 111 316. The inner core portion, which is made of a non-amorphous material, serves for reinforcement and increased rigidity of the core. It has been found that the transition between the inner and the outer core portion requires special attention. The material of the outer core portion should preferably be attached to the inner core portion so that tensile forces can be exerted during the winding of the outer core portion. Attachment should be performed in a reliable manner which is also suitable for mass production. It is an object of the invention to provide a core of the kind set forth which satisfies the above requirements.

To achieve this, the core in accordance with the invention is characterized in that the transition between the inner and the outer core portion is formed by a welded joint between the overlapping outer and inner end portions of the outer turn of the inner core portion with the inner end portion of the inner turn of the outer core portion disposed therebetween.

The core in accordance with the invention is preferably wound on a mandrel. On the mandrel there is first of all disposed the inner core portion, after which the inner end portion of the inner turn of the outer core portion is slid underneath the outer end portion of the outer turn of the inner core portion. The stack thus formed is joined by way of a welded joint. This welded joint is preferably formed by a spot weld. During welding, the (metal) winding mandrel can form a lower welding electrode so that, in order to realize the spot weld, it is sufficient to press a number of pin-shaped upper welding electrodes onto said stack. Consequently, the welding operation is very brief and the entire procedure, involving the winding of the inner core portion, the welding and the winding of the outer core portion, can be mechanized.

The inner core portion preferably consists of a single turn so that the volume of the core consists mainly of an amorphous material. Consequently, the magnetic field extends mainly through the amorphous material. In order to increase the magnetic resistance of the inner core portion so that the magnetic field is forced even further to the outer core portion, a further preferred embodiment of the core in accordance with the invention is characterized in that the strip-like material of the inner core portion is provided with at least one cut-out. The thickness of the non-amorphous strip material used to form the inner core portion is preferably at least ten times greater than the thickness of the amorphous strip material used to form the outer core portion. The inner core portion, which consists of one turn, thus is comparatively rugged. It may then be constructed as a preformed cylinder which can be bent open in a resilient manner in order to be arranged around the winding mandrel.

Figure 2:
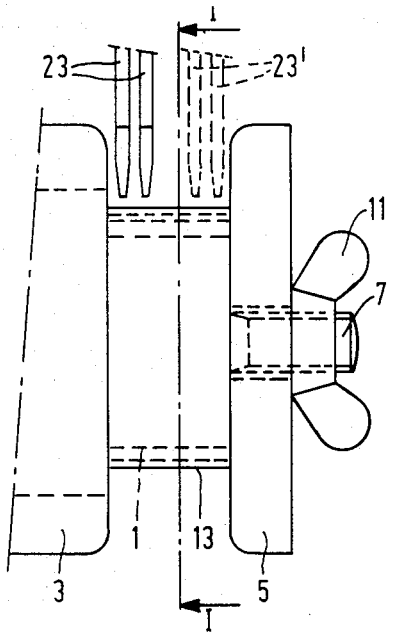
Figure 3:
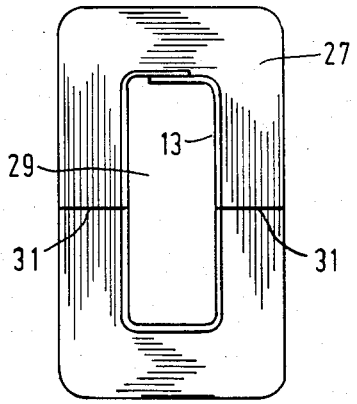
Figure 5:
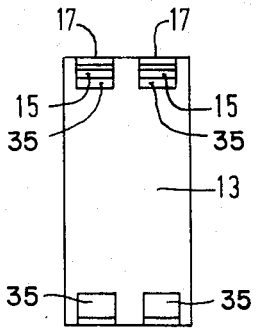
Figure 4:
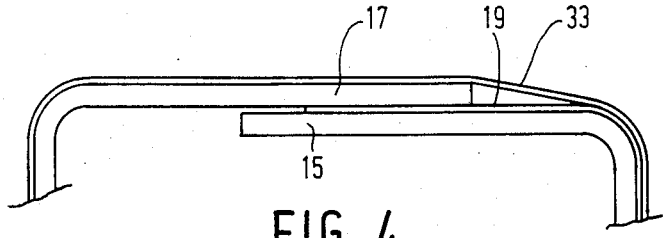

The invention will be described in detail hereinafter with reference to the accompanying diagrammatic drawing, in which:

FIG. 1 is a cross-sectional view of a winding mandrel during the manufacture of an embodiment of a ferromagnetic core in accordance with the invention, FIG. 2 is a side elevation of the winding mandrel shown in FIG. 1, FIG. 3 is a front view of an embodiment of a ferromagnetic core in accordance with the invention, FIG. 4 shows a detail (on an increased scale) of the core shown in FIG. 3, and FIG. 5 is a side elevation of an embodiment of a part for a ferro-magnetic core in accordance with the invention.

FIG. 1 is a cross-sectional view and FIG. 2 is a side elevation of a metal winding mandrel 1 which has a winding space which is bounded by two flanges 3 and 5. The winding mandrel 1 and the first flange 3 are rigidly mounted on a shaft 7 which can be rotated in the direction of the arrow 9 by means of a motor (not shown). The second flange 5 is detachably connected to the free end of the shaft 7 by means of a wing nut 11.

During the manufacture of a ferromagnetic core for a coil or transformer, first an inner core portion 13 is disposed on the winding mandrel 1, which portion consists in the present embodiment of a single turn of a non-amorphous, ferromagnetic strip material, for example silicon-iron. This turn includes an inner end portion 15 overlapped by an outer end portion 17. The free end 19 of a strip 21 of amorphous ferromagnetic material is arranged between said two end portions. Subsequently, pin-shaped welding electrodes 23 are pressed onto the stack of three layers of ferromagnetic material thus formed. To this end, these electrodes are movable in the vertical direction as denoted by the bidirectional arrow 25. The electrodes 23 are electrically connected to one pole of an electric welding generator (not shown) whose other pole is electrically connected to the winding mandrel 1. The two end portions 15 and 17 of the inner core portion 13 and the free end 19 of the strip 21 are thus spot-welded together. If desired, after the welding operation, the welding electrodes 23 may be displaced in the axial direction as denoted by the reference numeral 23' in FIG. 2, after which further spot welds can be made in the same manner.

After the spot welds have been made, the shaft 7 is rotated in the direction denoted by the arrow 9 so that the strip 21 is unwound from a feed reel (not shown) in order to be wound around the inner core portion 13, thus forming an outer core portion 27 (see FIG. 3). After formation of the number of turns required for the outer core portion 27 and after the outer free end of the strip 21 has been secured, for example by means of adhesive tape (not shown), the second flange 5 is removed from the shaft 7 so that the core can be removed from the winding mandrel 1. The space previously occupied by the winding mandrel then forms a core window 29. The core can subsequently be subjected to a number of known further operations, such as a heat treatment and an impregnation process, after which the core can be divided (if desired) into two portions along a plane 31, for example by sawing or grinding, after which the free end faces of the two core portions are polished. The plane 31 extends perpendicularly to the turns of the two core portions 13 and 27. During these operations the inner core portion 13 forms a support for the outer core portion 27 which has a lower mechanical strength.

FIG. 4 shows the transition between the inner core portion 13 and the outer core portion 27 on an enlarged scale. This figure shows that the free end 19 of the strip 21 is situated between the inner end portion 15 and the outer end portion 17 of the single turn of the inner core portion 13. The free end 19 constitutes the inner end portion of the inner turn 33 of the outer core portion 27. The further course of the inner turn 33 at the area of the transition between the two core portions is also shown in FIG. 4.

The inner core portion 13 of the described embodiment includes only a single turn of a non-amorphous strip material whose thickness is at least ten times greater than that of the strip 21 of amorphous material used to form the outer core portion 27. In one embodiment the strip 21 consists of an amorphous iron tape having a thickness of 22 μm and the inner core portion 13 consists of a silicon-iron strip having a thickness of 350 μm. The inner core portion 13 then consists of a preformed cylinder which is shown in a side elevation in FIG. 5 and whose ends can be resiliently bent away from each other in order to arrange the cylinder around the winding mandrel 1. The strip-like material used to form this cylinder is provided with cutouts 35 in order to increase the magnetic resistance of the inner core portion 13 so that the magnetic field extends substantially completely through the outer core portion 27 which consists of amorphous material having very attractive magnetic properties. In the present embodiment the cut-outs 35 are formed by two holes at each of the four corners of the cylinder. It is alternatively possible to use a strip material having a small thickness for the inner core portion 13, in which case it may be desirable to form more than one turn, for example from a feed reel in the same way as described for the winding of the outer core portion 27. The free end 15 of the outer turn of the inner core portion 13 then continues in the turns which are situated further inwards.

What is claimed is:

1. A core for an electric coil or transformer comprising: a number of concentric turns of a ferromagnetic strip material having an inner core portion which includes at least one turn made of a non-amorphous material and an outer core portion which encloses the inner core portion and comprises an amorphous material, characterized in that a transition between the inner and the outer core portion is formed by a welded joint between overlapping outer and inner end portions of an outer turn of the inner core portion and with an inner end portion of an inner turn of the outer core portion being disposed therebetween.

2. A core as claimed in claim 1, characterized in that the welded joint is a spot weld.

3. A core as claimed in claim 1 wherein the inner core portion comprises a single turn.

4. A core as claimed in claim 3, characterized in that the strip material of the inner core portion includes at least one cut-out.

5. A core as claimed in claim 4, characterized in that the thickness of the non-amorphous strip material of the inner core portion is at least ten times greater than the thickness of the amorphous strip material of the outer core portion.

6. A core as claimed in claim 1, characterized in that the core is divided into two portions along a plane which intersects the turns perpendicular to the longitudinal direction of the strip material.

7. A core as claimed in claim 2 wherein the inner core portion comprises a single turn of non-amorphous material.

8. A core as claimed in claim 1 wherein the strip material of the inner core portion includes at least one cut-out.

9. A core as claimed in claim 3 wherein the non-amorphous strip material of the inner core portion is at least ten times thicker than the amorphous strip material of the outer core portion.

10. A core as claimed in claim 3 wherein the core is divided into two portions along a plane which intersects the turns perpendicular to the longitudinal direction of the strip material.

11. A core as claimed in claim 8 wherein the core is divided into two portions along a plane which intersects the turns perpendicular to the longitudinal direction of the strip material.

12. A core as claimed in claim 9 wherein the core is divided into two portions along a plane which intersects the turns perpendicular to the longitudinal direction of the strip material.

* * * * *